US008034520B2

(12) United States Patent
Hayashi et al.

(10) Patent No.: US 8,034,520 B2
(45) Date of Patent: Oct. 11, 2011

(54) MAGENTA TONER FOR DEVELOPING ELECTROSTATIC IMAGE

(75) Inventors: Kenji Hayashi, Hachioji (JP); Mikio Kouyama, Kunitachi (JP); Hiroyuki Yasukawa, Hachioji (JP); Hiroaki Obata, Hino (JP); Natsuko Kusaka, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 373 days.

(21) Appl. No.: 12/335,220

(22) Filed: Dec. 15, 2008

(65) Prior Publication Data

US 2009/0162776 A1 Jun. 25, 2009

(30) Foreign Application Priority Data

Dec. 21, 2007 (JP) ..... 2007-329974

(51) Int. Cl.
*G03G 9/09* (2006.01)

(52) U.S. Cl. ..... 430/108.1; 430/109.1

(58) Field of Classification Search ..... 430/108.1, 430/109.1

See application file for complete search history.

(56) References Cited

FOREIGN PATENT DOCUMENTS

| | | |
|---|---|---|
| JP | 53144741 | * 12/1978 |
| JP | 62015557 | * 1/1987 |

OTHER PUBLICATIONS

Abstract of JP 53144741 Dec. 1978.*
Abstract of JP 62015557 Jan. 1987.*

* cited by examiner

*Primary Examiner* — Hoa Le
(74) *Attorney, Agent, or Firm* — Squire, Sanders & Dempsey (US) LLP

(57) ABSTRACT

Disclosed is a magenta toner, which contains magenta colorants composed of compound A represented by Formulas (1), (2) or (3) in an amount of mA and compound B selected from a group consisting of a mono-azo pigment, a naphthol pigment and rhodamine chelate pigment in an amount of mA, and a ratio of amount mA:mB is 90:10 to 55:45.

Formula (1)

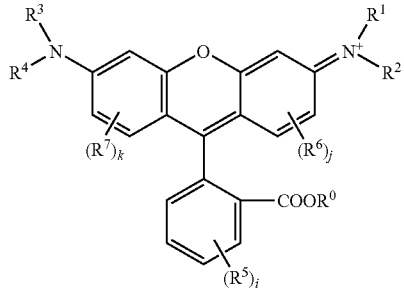

Formula (2)

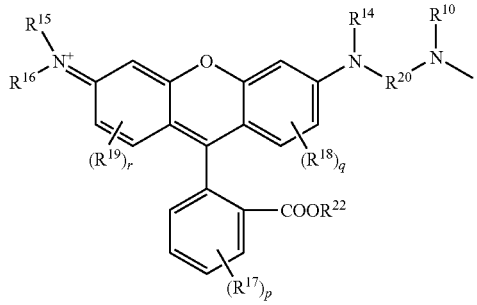

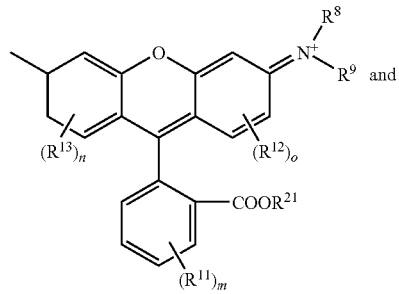

Formula (3)

$[Rh]_s[E^{r-}]_u$ are described in the specification.

10 Claims, No Drawings

MAGENTA TONER FOR DEVELOPING ELECTROSTATIC IMAGE

This application is based on Japanese Patent Application No. 2007-329974 filed on Dec. 21, 2007, the entire content of which is hereby incorporated by reference.

FIELD OF THE INVENTION

This invention relates to a magenta toner for forming an electrophotographic image.

TECHNICAL BACKGROUND

Colorization of a printer has been progressed and a high quality image is requested from a market.

Mono-azo pigments or quinacridone pigments have been used for a colorant of a magenta toner in general. However, these magenta colorants have a problem that they do not display a high durability against light and a broad color gamut with high brightness compatibly.

For dissolving these problems patent document No. 1 discloses to use a quinacridone pigment in combination with a rhodamine type compound, and patent document No. 2 discloses to use a colorant comprising a kind of rhodamine pigment and kind of rhodamine dye, as the magenta colorant.

However, the colorant disclosed in Patent Document No. 1 has a problem in color reproduction of human skin color because of strong fluorescence, and the colorant disclosed in Patent Document No. 2 has a disadvantage of sublimation problem because the magenta toner containing the colorant stains the printing apparatus during heat fixing by its sublimation and accumulation inside of the apparatus. These magenta toners still have a problem of adjustment of color hue and heat resistance property.

Patent Document 1: JP A H05-11504
Patent Document 2: JP A H05-34980

DISCLOSURE OF THE INVENTION

The invention is attained on the above background and an object of the invention is to provide a magenta toner having a high durability against light fundamentally, and further high chroma, adequate color hue and heat resistance property.

A magenta toner of this invention comprises a colored particles containing a binder resin and a magenta colorant, wherein the magenta colorant comprises at least one colorant compound A represented by formulas (1), (2) or (3) in an amount of mA and at least one colorant compound B selected from a group consisting a monoazo pigment, a naphthol type pigment and a rhodamine lake pigment in an amount of mB, and a ratio of mA:mB is from 90:10 to 55:45.

Formula (1)

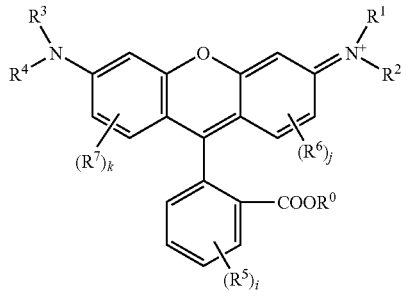

In the Formula (1) $R^1$ through $R^4$ each represents an alkyl group having 1-4 carbon atoms, a cycloalkyl group or an aryl group. $R^5$ is a methyl group or a halogen atom, and i is an integer of 0-4, provided that plural $R^5$s may be the same or different when i is 2-4. $R^6$ and $R^7$ each is a methyl group or a halogen atom and j and k each is an integer of 0-3, provided that plural $R^6$s and $R^7$s may be the same or different when j or k is 2 or 3. $R^0$ is an alkyl group having 1-6 carbon atoms, or an aryl group.

Formula (2)

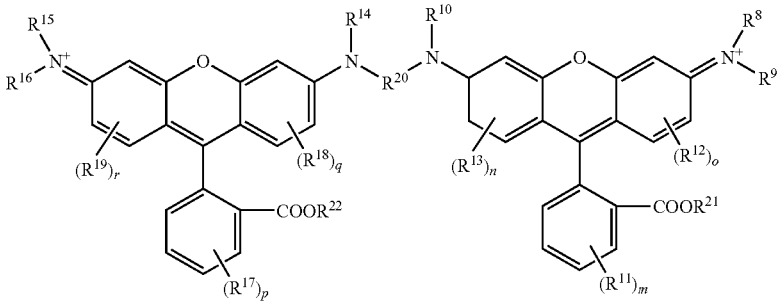

In the formula (2), $R^8$ through $R^{10}$ and $R^{14}$ through $R^{16}$ each is an alkyl group having 1-4 carbon atoms, a cycloalkyl group or aryl group. $R^{11}$ and $R^{17}$ each is a methyl group or a halogen atom and m and p each is an integer of 0-4, provided that plural $R^{11}$s and $R^{17}$s may be the same or different when m or p is 2 to 4. $R^{12}$, $R^{13}$, $R^{18}$ and $R^{19}$ each is a methyl group or a halogen atom and n, o, q and r each is an integer of 0-3, provided that plural $R^{12}$s, $R^{13}$s, $R^{18}$s and $R^{19}$s may be the same or different when n, o, q or r is 2 or 3. $R^{20}$ is —CO—, an alkylene group having 2-9 carbon atoms, or a dialkoxy group.

$R^{21}$ and $R^{22}$ each is a hydrogen atom, an alkyl group having 1-6 carbon atoms or an aryl group.

$$[\text{Rhod}]_s[E^{t-}]_u \qquad \text{Formula (3)}$$

In the Formula (3), Rhod is a rhodamine type tertiary ammonium compound represented by the Formulas (1) or (2), E is an anion other than sulfonic acid compound, t is a number of ionic valent of the anionic group E, u is an integer of 1 or 2, and s is a product of t and u.

The magenta toner particles preferably contain a releasing agent in the magenta toner of this invention. The toner particles have a softening point of preferably not less than 65° C. and not more than 100° C.

The magenta toner of this invention comprises a specific rhodamine type colorant A in combination with specific organic red pigment B. This magenta toner has a high durability against light fundamentally and further high chroma and an adequate color hue and heat resistance property, and therefore, high color reproduction in a wide color gamut from vivid tone to dark tone.

It may be discussed while the colorant A is excellent in vivid tone color reproduction because it has high chroma, however it is insufficient in dark tone color reproduction, the colorant A works complementally with the colorant B by addition of a specific amount ratio of the colorant B which obtains good dark tone color reproduction.

A human skin color formed by the magenta color of this invention in combination with other color toners has little hue change when the image is faded due to aged deterioration because the colorants of the magenta toner give high color reproduction in a wide color gamut from vivid tone to dark tone and color fading rate becomes similar to other color toners.

Further the magenta toner of this invention is excellent in anti-sublimation property and inhibits generation of stain inside the apparatus for long period use and therefore generation of image stain is suppressed when used for long period, since the magenta toner particles contain a releasing agent and the toner has the specifies softening point.

DESCRIPTION OF PREFERABLE EMBODIMENT

The present invention will be described more in detail.

The magenta toner of this invention is composed of magenta toner particles comprising a binder resin and magenta colorants described below.

Magenta Colorants

The colorant comprises at least one colorant compound A represented by a formulas (1), (2) or (3) in an amount of in A and at least one colorant compound B selected from a group consisting a monoazo pigment, a naphthol type pigment and a rhodamine lake pigment in an amount of mB, and a ratio of mA:mB is from 90:10 to 55:45.

Preferable examples of a compound of Formula (1) are listed.

(1-1)

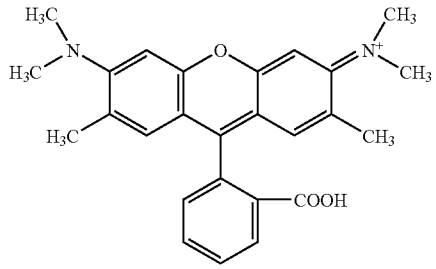

(1-2)

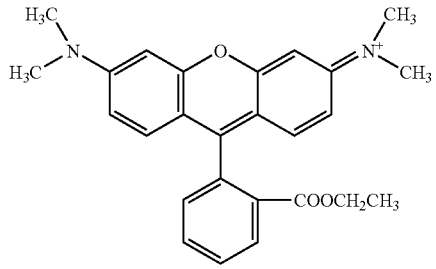

Preferable examples of a compound of Formula (2) are listed.

(2-1)

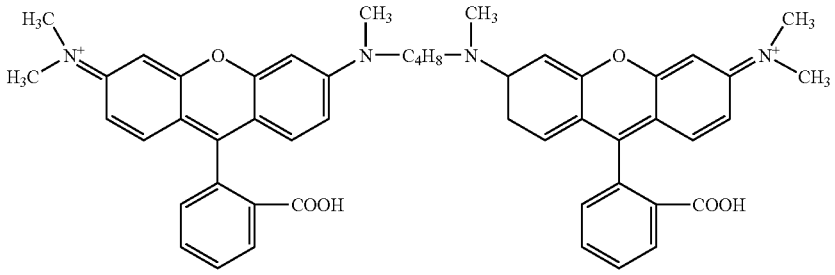

(2-2)

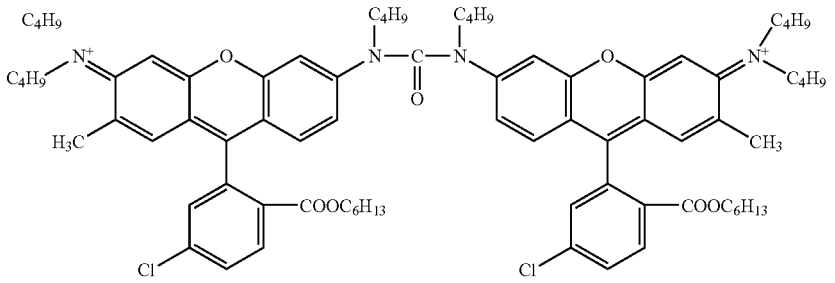

-continued

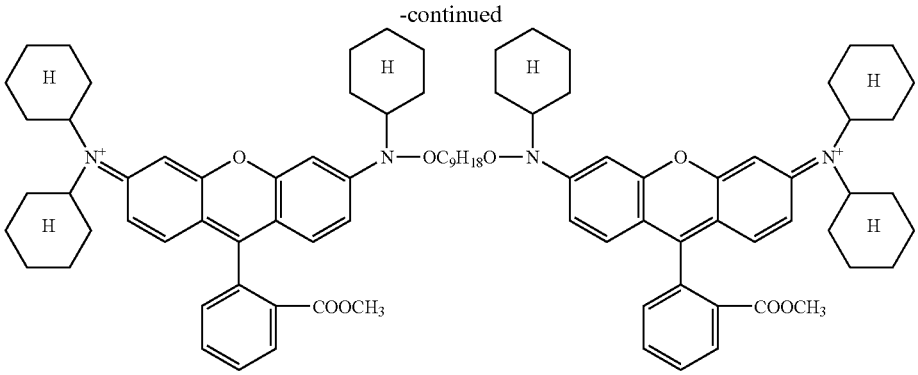

Examples of compound represented by Formula (3) are listed.

(3-1)

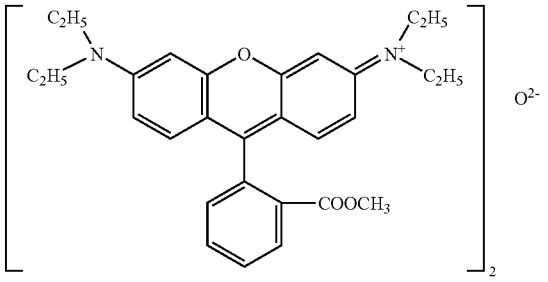

(3-2)

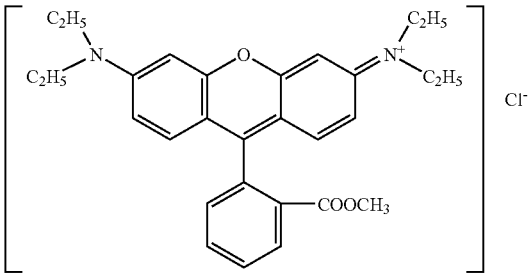

(3-3)

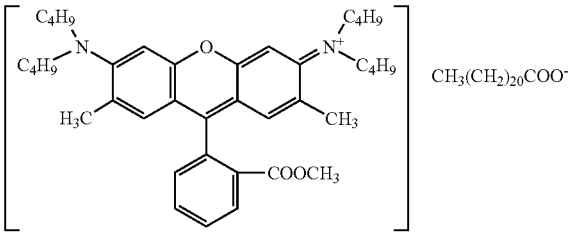

Preferable examples of the colorant compound B are described below.

Preferable example of the monoazo pigment includes C.I. Pigment Red 48:4, and C.I. Pigment Red 57.

Preferable example of the naphthol type pigment includes C.I. Pigment Red 7, C.I. Pigment Red 8, C.I. Pigment Red 14, C.I. Pigment Red 238, C.I. Pigment Red 5, C.I. Pigment Red 31, C.I. Pigment Red 146, C.I. Pigment Red 147, C.I. Pigment Red 184, C.I. Pigment Red 187, C.I. Pigment Red 212, C.I. Pigment Red 213, C.I. Pigment Red 222, C.I. Pigment Red 233, and C.I. Pigment Red 283, and particularly preferable examples among them are C.I. Pigment Red 187, C.I. Pigment Red 212, C.I. Pigment Red 213, C.I. Pigment Red 222, C.I. Pigment Red 233, and C.I. Pigment Red 238.

Preferable example of the rhodamine lake pigment includes C.I. Pigment red 81:4, and rhodamine silicomolybdate.

Chemical structures of the rhodamine compound represented by the Formulas (1) or (2) are those identified after stirring at 85° C. for 3 hours in aqueous solution at pH 4, then cooled down to room temperature.

The content of the magenta colorants is 2-12% by weight, preferably 4-10% by weight based on the total mass of magenta toner particles.

A hue angle of an image formed on plane paper by the magenta toner employing the magenta colorant of this invention is 300-36° represented by L*a*b* calorimetric system, in which brightness, hue of red-green area and hue of yellow-blue area are represented by L*, a* and b*, respectively.

Herein, the L*a*b* calorimetric system is a method preferably used to quantify a color. Both a* axis and b* axis represent the hue and chroma. The brightness refers to the relative brightness of a color, and the hue refers to color such as red, yellow, green, blue, or purple. The chroma refers to the degree of color vividness.

And the hue angle refers to an angle of a half line between a given coordinate point (a*, b*) and the original pint O measured in the counterclockwise direction from the plus (+) direction of the a* axis (the red direction) in an a* axis–b* axis coordinate plane. The minus (–) direction in a* axis represents green direction and plus (+) direction in b* axis represents yellow direction and minus direction in b* axis represents blue direction.

<Binder Resin>

Any appropriate binder resins can be used with no specific limitation.

Specific examples of such binder resins include, for example, a vinyl polymer such as a styrene resin, an acryl resin such as an alkylacrylate or an alkylmethacrylate, a styrene-acryl copolymeric resin, an olefin resin and a polyester resin. In particular, in order to enhance transparency and the color reproducibility of a superimposed image, a styrene resin and an acryl resin, which exhibit high transparency, as well as low viscosity of the melt and sharp-melt properties, are preferably used. These can be used individually or in combination of at least 2 types.

Further, as polymerizable monomers to obtain these binder resins, there can be used, for example, styrene monomers such as styrene, methylstyrene, methoxystyrene, butylstyrene, or phenylstyrene; (meth)acrylate monomers such as methyl acrylate, ethyl acrylate, butyl acrylate, ethylhexyl acrylate, methyl methacrylate, ethyl methacrylate, butyl methacrylate, or ethylhexyl methacrylate; and carboxylic acid-based monomers such as acrylic acid or fumaric acid. These can be used individually or in combination of at least 2 types.

As such binder resins, preferably used are the resins having a number average molecular weight (Mn) of 3,000-20,000, preferably 3,500-18,000; a ratio Mw/Mn of the weight average molecular weight (Mw) to the number average molecular weight (Mn) of 2-6, preferably 2.5-5.5; a glass transition point temperature (Tg) of 40-70° C., preferably 45-70° C.; and a softening temperature of 65-110° C., preferably 90-105° C.

The magenta toner particle may have a core-shell structure which is composed of a core particle containing magenta colorants in a binder resin and a shell layer composed of shell layer forming resin containing substantially no magenta colorant covering the core particle in the magenta toner of this invention. The shell layer forming resin may be referred to as "a shell resin". The shell resin is a different type resin from the binder resin composing core particle in this instance. A high production stability and high storage stability can be obtained by magenta toner particles having such a core-shell structure.

The magenta toner particles having a core-shell structure include a form in which the shell layer covers a part of the core particle as well as the shell layer covers the core particle completely. A part of a shell resin composing the shell layer may form a domain in the core particle. Further shell layer may be composed of two or more sub layers having different resin component.

Softening point temperature of the magenta toner is preferably not less than 65° C. and not more than 100° C. The softening point is determined as follows. Namely, initially, under an ambience of 20° C. and 50% relative humidity, 1.1 g of a magenta toner is placed in a Petri dish, flattened out, and allowed to stand for at least 12 hours. Thereafter, a 1 cm diameter cylindrical molded sample is prepared via application of a pressure of 3,820 kg/cm$^2$, employing molding machine "SSP-10A" (produced by Shimadzu Corp.). Subsequently, under an ambience of 24° C. and 50% relative humidity, by employing flow tester "CFT-500D" (produced by Shimadzu Corp.), the resulting sample is extruded from a cylindrical die hole (1 mm diameter×1 mm) employing a 1 cm diameter piston after pre-heating under conditions of an applied load of 196 N (20 kgf), an initial temperature of 60° C., pre-heating time of 300 seconds, and a temperature raising rate of 6° C./minute, and offset method temperature $T_{offset}$ which is determined based on the fusion temperature determination method of the temperature raising method, which is set at an offset value of 5 mm, is designated as the softening point temperature of the yellow toner.

<Production Method of Magenta Toner>

A production method of the magenta toner of the present invention is one in which particles composed of a binder resin (hereinafter referred to as "binder resin particles") and colorant particles containing a magenta colorant are aggregated and fused. Specifically, for example, an emulsion polymerization aggregation method is cited.

The emulsion polymerization aggregation method is a production method of toner particles in which a dispersion of binder resin particles, having been produced via an emulsion polymerization method, is mixed with a dispersion of other toner particle constituents such as colorant particles, and then slowly aggregated while maintaining a balance between the repulsive force of the particle surface which is controlled by pH adjustment and the aggregation force which is controlled by addition of a coagulant composed of an electrolyte; and the resulting product is associated while controlling the average particle diameter and the particle size distribution, and simultaneously fusion among the particles is carried out via heat-stirring for shape controlling.

Such a binder resin particle may be structured of at least two layers composed of binder resins having different compositions. In this case, there can be employed a method in which, in a dispersion of a first resin particle having been prepared via an emulsion polymerization treatment (first-step polymerization) based on a common method, a polymerization initiator and a polymerizable monomer are added and then the resulting system is subjected to another polymerization treatment (second-step polymerization).

One example of production processes to obtain the magenta toner of the present invention via the emulsion polymerization aggregation method will now specifically be described:

(1) Colorant particle dispersion preparation process to obtain a dispersion of colorant particles in which colorant particles containing a magenta colorant are dispersed in an aqueous medium;

(2) Binder resin particle polymerization process to obtain binder resin particles, in which a polymerizable monomer solution is prepared by dissolving or dispersing toner particle constituent materials such as a releasing agent and a charge control agent, if necessary, in a polymerizable monomer to form a binder resin, and the resulting solution is added in an aqueous medium to form oil droplets by applying mechanical energy, followed by conducting a polymerization reaction in the oil droplets, which is initiated by the radicals generated from a water-soluble radical polymerization initiator;

(3) Salting-out/aggregation/fusion process to form magenta toner particles, in which salting-out is conducted along with aggregation/fusion by adding a coagulant in an aqueous medium in which binder resin particles and colorant particles are dispersed, and by adjusting the temperature;

(4) Filtration/washing process to filter magenta toner particles from an aqueous medium and to remove substances such as a surfactant from the magenta toner particles;

(5) Drying process to dry magenta toner particles having been subjected to washing; and (6) Process to add an external additive to magenta toner particles having been subjected to drying.

Herein, the "aqueous medium" refers to a medium composed of 50-100% by weight of water and 0-50% by weight of a water-soluble organic solvent. As the water-soluble organic solvent, there can be exemplified methanol, ethanol, isopropanol, butanol, acetone, methyl ethyl ketone, and tetrahydrofuran. Alcohol-based organic solvent not dissolving any obtained resins are preferable.

In the colorant particle formation process, a dispersion of colorant particles, in which colorant particles are dispersed in an aqueous medium via mechanical energy, is prepared. Homogenizers to conduct oil droplet dispersion via mechanical energy are not specifically limited. Examples of a homogenizer include: "CLEAR MIX" (produced by M Technique Co., Ltd.) which is a homogenizer equipped with a high-speed rotating rotor, an ultrasonic homogenizer, a mechanical homogenizer, Manton-Gaulin homogenizer and a pressure-type homogenizer.

With regard to colorant particles in a dispersion prepared in this colorant particle formation process, the volume based median diameter thereof is preferably 10-500 nm, more preferably 10-100 nm and specifically preferably 10-50 nm.

The volume based median diameter of colorant particles is controlled within 10-500 nm, for example, by adjusting the magnitude of the mechanical energy of the above homogenizer.

Further, with regard to binder resin particles in a dispersion prepared in the binder resin particle polymerization process, the volume based median diameter thereof is preferably 30-50 nm.

[Chain Transfer Agent]

When magenta toner particles constituting the magenta toner of the present invention are produced via an emulsion polymerization aggregation method, any commonly used chain transfer agent can be employed to control the molecular weight of a binder resin. The chain transfer agent is not specifically limited, of which examples include: 2-chloroethanol; mercaptans such as octyl mercaptan, dodecyl mercaptan and t-dodecyl mercaptan; and styrene dimers.

[Polymerization Initiator]

When magenta toner particles constituting the magenta toner of the present invention are produced via an emulsion polymerization aggregation method, as a polymerization initiator to obtain a binder resin, any appropriate one can be used if being a water-soluble polymerization initiator. Specific examples of the polymerization initiator include: persulfates (such as potassium persulfate or ammonium persulfate), azo compounds (such as 4,4'-azobis4-cyano valerate and salts thereof, or 2,2'-azobis(2-amidinopropane)salt), and peroxide compounds.

[Surfactant]

Various anionic surfactants, cationic surfactants, and nonionic surfactants can be used as a surfactant to be used when magenta toner particles constituting the magenta toner of the present invention are produced via an emulsion polymerization aggregation method.

The anionic surfactants include, for example, higher fatty acid salts such as sodium oleate; alkylarylsulfonic acid salts such as sodium dodecylbenzenesulfonate; alkylsulfuric acid ester salts such as sodium laurylsulfate; polyoxyethylene alkyl ether sulfuric acid ester salts such as polyethoxyethylene lauryl ether sodium sulfate; polyoxyethylene alkyl aryl ether sulfuric acid ester salts such as polyoxyethylene nonyl phenyl ether sodium sulfate; alkylsulfosuccinic acid ester salts such as sodium monooctylsulfosuccinate, sodium dioctylsulfosuccinate, and polyoxyethylene sodium laurylsulfosuccinate; and derivatives thereof.

Further, the cationic surfactants include, for example, aliphatic amine salts, aliphatic quaternary ammonium salts, benzalkonium salts, benzethonium chloride, pyridinium salts, and imidazolinium salts.

The nonionic surfactants include, for example, polyoxyethylene alkyl ethers such as polyoxyethylene lauryl ether and polyoxyethylene stearyl ether; polyoxyethylene alkyl phenyl ethers such as polyoxyethylene nonyl phenyl ether; sorbitan higher fatty acid esters such as sorbitan monolaurate, sorbitan monostearate, and sorbitan trioleate; polyoxyethylene sorbitan higher fatty acid esters such as polyoxyethylene sorbitan monolaurate; polyoxyethylene higher fatty acid esters such as polyoxyethylene monolaurate and polyoxyethylene monostearate; glycerin higher fatty acid esters such as oleic acid monoglyceride and stearic acid monoglyceride; and polyoxyethylene-polyoxypropylene-block copolymers.

[Coagulant]

A coagulant to be used when magenta toner particles constituting the magenta toner of the present invention are produced via an emulsion polymerization aggregation method includes, for example, alkali metal salts and alkaline earth metal salts. The alkali metal constituting the coagulant includes lithium, potassium, and sodium. The alkaline earth metal constituting the coagulant includes magnesium, calcium, strontium, and barium. Of these, potassium, sodium, magnesium, calcium, and barium are preferable. A counter ion (namely an anion constituting a salt) of the alkali metal or alkaline earth metal includes chloride ion, bromide ion, iodide ion, carbonate ion, and sulfate ion.

[Releasing Agent]

An appropriate releasing agent, contributing to prevent offset phenomena, may be incorporated in magenta toner particles constituting the magenta toner of the present invention. Herein, the releasing agent is not specifically limited, including, for example, polyethylene wax, oxidized-form polyethylene wax, polypropylene wax, oxidized-form polypropylene wax, carnauba wax, Sasol wax, rice wax, candelilla wax, jojoba wax, and bees wax.

A method of incorporating a releasing agent into magenta toner particles includes a method wherein, in the salting-out/aggregation/fusion process to form magenta toner particles, a dispersion of releasing agent particles (a wax emulsion) is added to allow binder resin particles, colorant particles, and releasing agent particles to undergo salting-out, aggregation, and fusion; and a method wherein, in the salting-out/aggregation/fusion process to form magenta toner particles, binder resin particles and colorant particles containing a releasing agent are allowed to undergo salting-out, aggregation, and fusion. These methods may be employed in combination.

The content ratio of a releasing agent in magenta toner particles is commonly 0.5-5 parts by weight, preferably 1-3 parts by weight based on 100 parts by weight of a binder resin. When the content ratio of the releasing agent is less than 0.5 part by weight based on 100 parts by weight of the binder resin, the offset preventing effect becomes insufficient. In contrast, in cases of more than 5 parts by weight based on 100 parts by weight of the binder resin, a magenta toner obtained tends to exhibit poor translucency and poor color reproducibility.

Softening point temperature of the magenta toner is preferably not less than 65° C. and not more than 100° C., when the magenta toner particles contain a releasing agent. A magenta toner can be fixed lower temperature if magenta toner particles containing a releasing agent and having the above mentioned softening point. Sublimation of the colorant compound A is inhibited in case the magenta toner is employed in a high speed color apparatus, therefore stain of the fixing device by a sublimated magenta colorant compound used for long period, and images without stain can be obtained for long period as its result.

[Charge Control Agent]

Any appropriate charge control agent may be added in magenta toner particles constituting the magenta toner of the present invention. The charge control agent is not specifically limited, and there can be listed various substances providing positive or negative charges via frictional charging. For example, as a negatively chargeable charge control agent used for magenta toner particles, colorless, white, or light-colored charge control agents are listed so as not to adversely affect the hue or transparency of the magenta toner. Such charge control agents preferably include, for example, metal complexes of salicylic acid derivatives with zinc or chromium (salicylic acid metal complexes), calixarene compounds, organic boron compounds, and fluorine-containing quaternary ammonium salt compounds. Specifically, the salicylic acid metal complexes include, for example, those disclosed in JP-A S53-127726 and S62-145255, and the calixarene compounds include, for example, those disclosed in JP-A H02-201378. The organic boron compounds include, for example, those disclosed in JP-A H02-221967, and the fluorine-containing quaternary ammonium salt compounds include, for example, those disclosed in JP-A H03-1162.

The content ratio of a charge control agent in magenta toner particles is commonly 0.1-10 parts by weight, preferably 0.5-5 parts by weight based on 100 parts by weight of a binder resin.

There can be listed the same methods as the above ones to incorporate a releasing agent as a method of incorporating inner additives such as a charge control agent into magenta toner particles.

<Particle Diameter of Magenta Toner Particles>

The particle diameter of the magenta toner of the present invention is preferably, for example, a volume median diameter of 4-10 μm and more preferably 6-9 μm. This average particle diameter can be controlled by the concentration of a coagulant (a salting-out agent) used, the amount of an organic solvent added, the fusion time, or the composition of a polymer.

When the volume median diameter falls within the above range, transfer efficiency is increased, resulting in enhanced half-tone image quality as well as enhanced thin-line and dot image quality.

The volume median diameter of a magenta toner is measured and calculated using a measurement device of "Coulter Multisizer TA-III" (produced by Beckman Coulter, Inc.) and a data processing computer system (produced by Beckman Coulter, Inc.) connected thereto. Specifically, 0.02 g of the toner is added in 20 ml of a surfactant solution (a surfactant solution prepared, for example, via ten-fold dilution of a neutral detergent containing a surfactant composition with purified water in order to disperse the magenta toner), followed by being wetted and then subjected to ultrasonic dispersion for 1 minute to prepare a magenta toner dispersion. The magenta toner dispersion is injected into a beaker set on the sample stand, containing "ISOTON II" (produced by Beckman Coulter, Inc.), using a pipette until the concentration indicated by the measurement device reaches 8%. This concentration makes it possible to obtain reproducible measurement values. Then, a measured particle count number and an aperture diameter are adjusted to 25,000 and 50 μm, respectively, in the measurement device, and a frequency value is calculated by dividing a measurement range of 1-30 μm into 256 parts. The particle diameter at the 50% point from the higher side of the volume accumulation fraction is designated as the volume median diameter.

<External Additive>

The above described magenta toner particles themselves can constitute the magenta toner of the present invention. However, to improve fluidity, chargeability, and cleaning properties, the magenta toner particles may be added with an external additive, so-called a post-treatment agent, such as a fluidizer, or a cleaning aid, to form the magenta toner of the present invention.

The post-treatment agent includes, for example, inorganic oxide particles such as silica particles, alumina particles, or titanium oxide particles; stearate particles such as aluminum stearate particles or zinc stearate particles; or inorganic titanate particles such as strontium titanate or zinc titanate. These can be used individually or in combination of two or more types.

These inorganic particles are preferably subjected to surface treatment with a silane coupling agent, a titanium coupling agent, a higher fatty acid, or silicone oil to enhance heat-resistant storage stability and environmental stability.

The total added amount of these various external additives is 0.05-5 parts by weight, preferably 0.1-3 parts by weight based on 100 parts by weight of the magenta toner. Further, various appropriate external additives may be used in combination.

[Developer]

The magenta toner of the present invention may be used as a magnetic or non-magnetic single-component toner or a two-component toner by mixing with carriers. When the magenta toner of the present invention is used as a two-component toner, magnetic particles may be used as a carrier, including metals such as iron, ferrite, or magnetite, as well as alloys of the above metals with metals such as aluminum or lead, and ferrite particles are specifically preferable. Further, it is also possible to use, as the carrier, coated carriers in which the surface of magnetic particles is coated with a coating agent such as a resin; or binder-type carriers composed of magnetic fine powders dispersed in a binder resin.

A coating resin to form the coated carrier is not specifically limited, including, for example, olefin resins, styrene resins, styrene-acryl resins, silicone resins, ester resins, and fluorine resins. Further, any appropriate resin known in the art can be used as a resin forming the resin-dispersion type carriers, without specific limitation, including, for example, styrene-acryl resins, polyester resins, fluorine resins, and phenol resins.

The volume median diameter of the carriers is preferably 20-100 μm, more preferably 20-60 μm. The volume median diameter of the carriers can be determined typically with laser diffraction type particle size distribution meter "HELOS" (produced by Sympatec Co.) equipped with a wet-type homogenizer.

Carrier coated with a silicone resin is preferably employed as a preferable carrier from the viewpoint of anti-spent properties.

EXAMPLES

The present invention will now be described more in detail by examples.

In the following examples, a volume median diameter was determined using "MICROTRAC UPA-150" (produced by Honeywell International, Inc.) under such measurement conditions that the sample refractive index was 1.59; the sample specific gravity was 1.05 in terms of a spherical particle; the solvent refractive index was 1.33; and the solvent viscosity was $0.797\times10^{-3}$ Pa·s at 30° C. and $1.002\times10^{-3}$ Pa·s at 20° C. Herein, zero-point adjustment was conducted by placing ion-exchanged water in a measuring cell.

Preparation of Colorant Particle Dispersion A1

Surfactant solution was prepared by dissolving 9.2 g of sodium n-dodecyl sulfate in 160 g of ion-exchanged water with stirring. To this surfactant solution 20 g of exemplified rhodamine compound of formula (3-2) was added gradually with stirring, then it was dispersed by employing CLEARMIX, manufactured by M-technique Co., to obtain Colorant Particle Dispersion A1 having a volume based median particle diameter of 195 nm.

Colorant Particle Dispersions A2 through A8 were prepared in the similar way to Colorant Particle Dispersion A1 except that the rhodamine compounds shown in Table 1-1 were used in place of exemplified rhodamine compound of formula (3-2).

TABLE 1-1

| Colorant Particle Dispersion | Colorant, Exemplified | volume based median particle diameter |
|---|---|---|
| A1 | (3-2) | 195 nm |
| A2 | (1-1) | 204 nm |
| A3 | (1-2) | 222 nm |
| A4 | (3-3) | 198 nm |
| A5 | (2-1) | 211 nm |
| A6 | (2-2) | 265 nm |
| A7 | (2-3) | 246 nm |
| A8 | (3-1) | 209 nm |

Colorant Particle Dispersions B1 through B7 were prepared in the similar way to Colorant Particle Dispersion A1 except that the colorant compounds shown in Table 1-2 were used in place of exemplified rhodamine compound of formula (3-2).

TABLE 1-2

| Colorant Particle Dispersion | Colorant | volume based median particle diameter |
|---|---|---|
| B1 | C.I. Pigment Red 48:4 | 164 nm |
| B2 | C.I. Pigment Red 57 | 232 nm |
| B3 | C.I. Pigment Red 238 | 245 nm |
| B4 | C.I. Pigment Red 187 | 179 nm |
| B5 | C.I. Pigment Red 212 | 197 nm |
| B6 | C.I. Pigment Red 213 | 166 nm |
| B7 | C.I. Pigment Red 222 | 196 nm |

Preparation of Colorant Particle Dispersion C

Colorant Particle Dispersion C was prepared in the similar way to Colorant Particle Dispersion A1 except that a cyan colorant compound C.I. Pigment Blue 15:3 was used in place of exemplified rhodamine compound of formula (3-2). Colorant Particle Dispersion C having a volume based median particle diameter of 195 nm was obtained.

Preparation of Colorant Particle Dispersion Y

Colorant Particle Dispersion C was prepared in the similar way to Colorant Particle Dispersion A1 except that a yellow colorant compound C.I. Pigment Yellow 74 was used in place of exemplified rhodamine compound of formula (3-2). Colorant Particle Dispersion Y having a volume based median particle diameter of 177 nm was obtained.

Preparation of Colorant Particle Dispersion K

Colorant Particle Dispersion C was prepared in the similar way to Colorant Particle Dispersion A1 except that a carbon pigment, carbon black MOGAL L, manufactured by Cabot Corp., was used in place of exemplified rhodamine compound of formula (3-2). Colorant Particle Dispersion K having a volume based median particle diameter of 126 nm was obtained.

[Preparation of Resin Particle for Core Particle]

Core resin particles having a multi-layer structure was prepared via the first, second and third step polymerizations described below.

(a) First Step Polymerization

The following surfactant in an amount of 4 parts by weight as well as 3040 weight parts of ion-exchanged water were charged, and mixed in a reaction vessel on which a stirrer, thermal sensor, cooling tube and nitrogen introducing device were attached.

Surfactant (S): $C_{10}H(OCH_2CH_2)SO_3Na$

Polymerization initiator solution containing 10 parts by weight of potassium persulfate (KPS) dissolved in 400 parts by weight of ion-exchanged water was added to the above described surfactant solution, and heated up to 75° C., a monomer mixture solution containing the following compounds was dripped into the reacting vessel taking 1 hour.

| | |
|---|---|
| Styrene | 532 parts by weight |
| n-butyl acrylate | 200 parts by weight |
| Methacrylic acid | 68 parts by weight |
| n-octyl mercaptan | 16.4 parts by weight |

Polymerization (first step of polymerization) was performed by heating at 75° C. and stirring the system for 2 hours to prepare Resin Particles A1. Weight average molecular weight of the Resin Particles A1 was 16,500.

(b) Second Step Polymerization

To a flask equipped with a stirring device the following monomer compound mixture was poured, then 93.8 parts by weight of Paraffin wax HNP-57, manufactured by Nippon Seiro Co., Ltd. was added and a monomer solution was prepared by heating up to 90° C.

| | |
|---|---|
| Styrene | 101.1 parts by weight |
| n-butyl acrylate | 62.2 parts by weight |
| Methacrylic acid | 12.3 parts by weight |
| n-octylmercaptan | 1.75 parts by weight |

A surfactant solution composed of 3 parts by weight of the above described anionic surfactant (S) was prepared by dissolving in 1,560 parts by weight of ion-exchanged water, and it was heated up to 98° C.

To this surfactant solution 32.8 parts by weight (solid converted amount) Resin Particles A1 was added and the above prepared monomer solution containing the paraffin wax was added, the mixture was subjected to blending and dispersion by employing a mechanical dispersion apparatus equipped with a circulation pass CLEAR MIX manufactured by M Technique Co., taking 8 hours. A dispersion containing emulsified particles having dispersion particle diameter of 340 nm was prepared. To the above dispersion particle, an initiator solution prepared by dissolving 6 parts by weight of potassium persulfate in 200 parts by weight of ion-exchanged water was added and the second step polymerization was performed by heating and stirring for 12 hours at a temperature condition of 98° C. to obtain resin particles LX2. Weight average molecular weight of LX2 was 23,000.

(c) Third Step Polymerization

An initiator solution composed of 5.45 parts by weight of potassium peroxide dissolved in 220 parts by weight of ion-exchanged water was added to the reaction system of above prepared resin particles LX2, then monomer mixture composed of

| | |
|---|---|
| Styrene | 293.8 parts by weight |
| n-butyl acrylate | 154.1 parts by weight |
| n-octylmercaptan | 7.08 parts by weight |

was dripped taking 1 hour at 80° C., the third step polymerization was performed by heating and stirring for 2 hours, and it was cooled down to 28° C. after completion of polymerization to obtain resin particles for Core Particle (1) was prepared. Weight average particle molecular weight of the Core Particle (1) was 26,800.

Preparation of Resin Particles for Shell (1)

Resin particles for shell (1) was prepared in the similar way to the first polymerization of the preparation of Core Particle 1, except that the composition of the monomer mixture solution was replaced by the following compounds.

| | |
|---|---|
| Styrene | 624 parts by weight |
| n-butyl acrylate | 120 parts by weight |
| Methacrylic acid | 56 parts by weight |
| n-octyl mercaptan | 16.4 parts by weight |

Preparation of Toner Particles 1

(a) Preparation of Core Particles

Into a reaction vessel on which a thermal sensor, cooling tube and nitrogen introducing device were attached, 420.7 parts by weight in terms of solid component of Core Resin Particles (1), 900 parts by weight of deionized water and 180 parts by weight of Colorant Particle Dispersion A1 and Colorant Particle Dispersion B3 were charged and stirred. The temperature of the contents was adjusted at 30° C. and the pH of the liquid was adjusted to 10 by adding a 5 mole/L solution of sodium hydroxide solution.

Then an aqueous solution prepared by dissolving 2 parts by weight of magnesium chloride hexahydrate in 1,000 parts by weight of deionized water was added spending 10 minutes at 30° C. After standing for 3 minutes, the system was heated by 65° C. spending 60 minutes. In such the situation, the diameter of the associated particle was measured by Coulter Multisizer 3, manufactured by Coulter Inc., and an aqueous solution composed of 40.2 parts by weight of sodium chloride and 1,000 parts by weight of deionized water was added for stopping growth of the particles when the volume based median diameter of the particles ($D_{50}$) becomes 5.5 μm. Furthermore, the ripening was carried out for continuing fusion by heating and stirring for 1 hour at a liquid temperature of 70° C. to obtain Core Particles (1).

The circular degree of Core Particles (1) measured by FPIA-2100, manufactured by Sysmex Co., Ltd., was 0.912.

(b) Preparation of Shell Layer

To the obtained Core Particles (1) whose temperature was adjusted to 65° C., 96 parts by weight of the Resin particles for shell (1) was added, further, an aqueous solution composed of 2 parts by weight of magnesium chloride hexahydrate and 1,000 parts by weight of ion-exchanged water was further added spending 10 minutes and the temperature was raised by 70° C. (shell forming temperature). The system was further stirred for 1 hour for fusing Resin Particles for Shell onto the Core 1. Then ripening was conducted at 75° C. for 20 min. to form a shell layer.

To the system, 40.2 parts by weight of sodium chloride was added and the system was cooled by 30° C. at a cooling rate of 8° C./minute. The resulted particles were washed with ion-exchanged water at 45° C. repeatedly then dried via warm air at 40° C. to obtain Toner Particles (1) having a shell layer coated on a core particle.

Preparation of Toner Particles (2) Through (24)

Toner Particles (2) through (24) were prepared in the similar way as the Toner Particles (1), except that "180 parts by weight of Colorant Particle Dispersion A1 and Colorant Particle Dispersion B3" was replaced by Colorant Dispersions shown in Table 2. The total amount of the Colorant Dispersions were maintained as 200 parts by weight satisfying a described mA:mB ratio.

Preparation of Toner Particles (25)

Mixture of 100 parts by weight of unsaturated polyester resin, 2 parts by weight of quinacridone pigment, C.I. Pigment Violet 19, 2 parts by weight of rhodamine compound represented by Formula X and chromium salicylic acid complex were subjected to melt-kneading by heat rolls, and the resultant was pulverized roughly by a hammer mill after cooled, then finely pulverized by an air jet type fine mill. The obtained powder was classified to obtain magenta toner particles (25) having 5-25 μm particle diameter.

Formula X

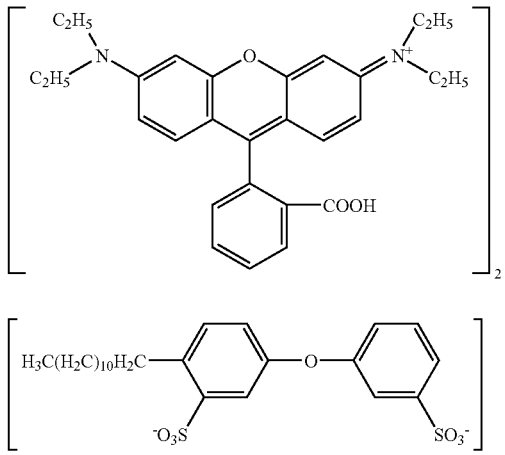

Preparation of Toner Particles (26)

Mixture of 100 parts by weight of styrene-acrylic acid ester resin, HIMER TBL 500, manufactured by Sanyo Chemical Industries, Ltd., 4 parts of polypropylene, BISCOL 550 P, manufactured by Sanyo Chemical Industries, Ltd., 2 parts of a charge control agent, E-84, manufactured by Orient Chemical Industries, Ltd., 2.5 parts of C.I. Solvent Red 49 (commercial name of Oil Pink 312) manufactured by Orient Chemical Industries, Ltd., and 2.5 parts of C.I. Pigment Red 57:1 (commercial name of Brilliant Carmine 6BG) manufactured by Toyo Ink MFG., Co., Ltd., were dispersed homogeneously by Henschel Mixer, and the dispersion was subjected to melt-kneading by a biaxial extruder, and was pulverized by a jet mill after cooled, to obtain a classified particles having an average particle diameter of 11 mm by a classifying machine. The obtained toner particles are referred as magenta toner particles 26.

Preparation of Cyan, Yellow and Black Toner Particles (27) Through (29)

Toner Particles (27) through (29) were prepared in the similar way as the Toner Particles (1), except that "180 parts by weight of Colorant Particle Dispersion A1 and Colorant Particle Dispersion B3" was replaced by 200 g of Colorant Particle Dispersion C, Colorant Particle Dispersion Y and Colorant Particle Dispersion K, respectively.

Addition of External Additives

Each of 1 part by weight of hydrophobic silica having number average primary particle diameter of 12 nm and hydrophobicity of 68, and hydrophobic titanium oxide having number average primary particle diameter of 20 nm and hydrophobicity of 63 were added to each Toner Particles (1)

through (29), then they were mixed by Henschel Mixer, large particles were removed by a sieve having an aperture of 45 μm to obtain Toners (1) through (29).

Preparation of Developer

Two component developers (1) through (29) were prepared by adding silicon resin coated ferrite carrier having a volume average particle diameter of 60 μm so that toner content has 6% by weight in each developer.

Printing evaluation was conducted using each of the magenta developers (1) through (26) in combination with the cyan, yellow and black developers. The composite color printing machine BIZHUB C250, manufactured by Konica Minolta Business Technologies Inc., was employed and printing condition was adjusted so that amount of each toner fixed on a paper was 0.5 mg/cm$^2$ and secondary color was composed of each primary colors superposed in an amount of 1:1.

(1) Aged Skin Color Change

Skin color image of Standard High Precision Picture data N1 "Woman with glass" provided by IIEEJ was printed out by color printing machine BIZHUB C250 on an art paper "TOKUBISHI ART" manufactured by Mitsubishi Paper Mills Ltd. The printed samples were exposed to air in a glass box to keep from wetting by rain for three weeks in May on a roof of building in Tokyo. The images were evaluated by the following norm.

A: Excellent in all of hue, chroma and brightness.

B: No problem in skin color but having slight blue or red.

C: Problematic in skin color because of insufficient at least one of hue, chroma and brightness.

D: Far from original skin color.

(2) Anti-Sublimation

Each colorant employed in the developers (1) through (26) in an amount of 0.2 g was put into a crucible and high quality paper "Konica Minolta CF Paper" manufactured by Konica Minolta Business Technologies Inc., was imposed of a cover of the crucible . The covered crucible was heated 180° C. for 6 hours and coloring on the CF Paper was observed with eyes. Further, stain inside of a printing machine was observed with eyes after 100,000 sheets printing by BIZHUB C6500, manufactured by Konica Minolta Business Technologies Inc., employing each of the developers (1) through (26). Evaluation norm was as follows.

A: No coloration on CF Paper and no stain inside of a printing machine were observed.

B: Slight red coloring on CF Paper but no problematic stain inside of a printing machine were observed.

C: Red tinged on CF Paper and stain inside of a printing machine were observed.

D: Deep red colored on CF Paper and noticeable stain inside of a printing machine were observed.

The results are summarized in Table 2.

Developer samples (1) through (18) show high skin color reproduction after aging and high anti-sublimation property in comparison with the samples (19) through (26).

TABLE 2

| | Colorant A | | | Colorant B | | | Skin | | |
|---|---|---|---|---|---|---|---|---|---|
| Toner No. | | Dispersion | Amount parts | | Dispersion | Amount parts | mA:mB | Color Change | Anti sublimation |
| 1 | (3-2) | A1 | 180 | C.I.P.R. 238 | B3 | 20 | 90:10 | B | B |
| 2 | (1-1) | A2 | 140 | C.I.P.R. 238 | B3 | 60 | 70:30 | A | A |
| 3 | (1-2) | A3 | 120 | C.I.P.R. 238 | B3 | 80 | 60:40 | A | A |
| 4 | (3-3) | A4 | 150 | C.I.P.R. 238 | B3 | 50 | 75:25 | A | A |
| 5 | (2-1) | A5 | 160 | C.I.P.R. 238 | B3 | 40 | 80:20 | A | A |
| 6 | (2-2) | A6 | 110 | C.I.P.R. 238 | B3 | 90 | 55:45 | B | A |
| 7 | (2-3) | A7 | 180 | C.I.P.R. 48:4 | B1 | 20 | 90:10 | A | A |
| 8 | (4-33-4) | A8 | 140 | C.I.P.R. 48:4 | B1 | 60 | 70:30 | A | A |
| 9 | (1-1) | A2 | 120 | C.I.P.R. 48:4 | B1 | 80 | 60:40 | A | A |
| 10 | (3-2) | A1 | 140 | C.I.P.R. 57 | B2 | 60 | 70:30 | A | A |
| 11 | (1-2) | A3 | 180 | C.I.P.R. 187 | B4 | 20 | 90:10 | A | B |
| 12 | (2-1) | A5 | 160 | C.I.P.R. 212 | B5 | 40 | 80:20 | A | A |
| 13 | (2-2) | A6 | 140 | C.I.P.R. 213 | B6 | 60 | 70:30 | A | A |
| 14 | (2-3) | A14 | 120 | C.I.P.R. 222 | B7 | 80 | 60:40 | A | A |
| 15 | (3-3) | A4 | 150 | C.I.P.R. 233 | B8 | 50 | 75:25 | A | A |
| 16 | (2-1) | A5 | 110 | C.I.P.R. 81:4 | B9 | 90 | 55:45 | B | B |
| 17 | (2-2) | A6 | 140 | C.I.P.R. 81:4 | B9 | 60 | 70:30 | A | A |
| 18 | (2-3) | A7 | 180 | C.I.P.R. 81:4 | B9 | 20 | 90:10 | B | A |
| 19 | — | — | — | C.I.P.R. 212 | B5 | 200 | 0:100 | C | A |
| 20 | (3-2) | A1 | 200 | — | — | — | 100:0 | C | C |
| 21 | (3-3) | A4 | 200 | — | — | — | 100:0 | C | C |
| 22 | (3-2) | A1 | 80 | C.I.P.R. 238 | B3 | 120 | 40:60 | C | B |
| 23 | (3-2) | A1 | 20 | C.I.P.R. 238 | B3 | 180 | 10:90 | C | B |
| 24 | — | — | — | C.I.P.R. 81:4 | B9 | 100 | 0:100 | D | A |
| 25 | Rhodamine [X] | — | 100 | C.I.P.V. 19(*) | — | 100 | 50:50 | D | C |
| 26 | C.I.S.R. 49(**) | — | 100 | C.I.P.R. 57:1 | — | 100 | 50:50 | D | C |

C.I.P.R.: C.I. Pigment Red
C.I.P.V. 19(*): C.I. Pigment Violet 19
C.I.S.R. 49(**): C.I. Solvent Red 49

The invention claimed is:

1. A magenta toner for forming an electrophotographic image comprising magenta toner particles containing a binder and a magenta colorant, wherein the magenta colorant is composed of compound A represented by Formulas (1), (2) or (3) in an amount of mA and compound B selected from a group consisting of a mono-azo pigment, a naphthol pigment and a rhodamine chelate pigment in an amount of mB, and a ratio of amount mA:mB is 90:10 to 55:45, Formula (1)

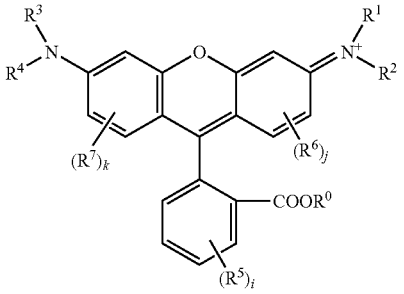

in the Formula (1) $R^1$ through $R^4$ each represents an alkyl group having 1-4 carbon atoms, a cycloalkyl group or an aryl group; $R^5$ is a methyl group or a halogen atom, and i is an integer of 0-4, provided that plural $R^5$s may be the same or different when i is 2-4; $R^6$ and $R^7$ each is a methyl group or a halogen atom and j and k each is an integer of 0-3, provided that plural $R^6$s and $R^7$s may be the same or different when j or k is 2 or 3; and $R^0$ is an alkyl group having 1-6 carbon atoms, or an aryl group, Formula (2)

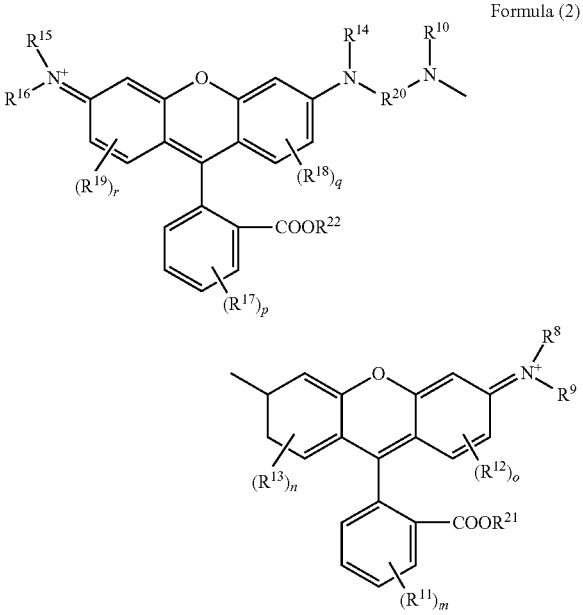

in the Formula (2), $R^8$ through $R^{10}$ and $R^{14}$ through $R^{16}$ each is an alkyl group having 1-4 carbon atoms, a cycloalkyl group or an aryl group; $R^{11}$ and $R^{17}$ each is a methyl group or a halogen atom and m and p each is an integer of 0-4, provided that plural $R^{11}$s and $R^{17}$s may be the same or different when m or p is 2 to 4; $R^{12}$, $R^{13}$, $R^{18}$ and $R^{19}$ each is a methyl group or a halogen atom and n, o, q and r each is an integer of 0-3, provided that plural $R^{12}$s, $R^{13}$s, $R^{18}$s and $R^{19}$s may be the same or different when n, o, q or r is 2 or 3; $R^{20}$ is —CO—, an alkylene group having 2-9 carbon atoms, or a dialkoxy group; and $R^{21}$ and $R^{22}$ each is a hydrogen atom, an alkyl group having 1-6 carbon atoms or an aryl group, $$[\text{Rhod}]_s[E^{t-}]_u \qquad \text{Formula (3)}$$

in the Formula (3), Rhod is a compound represented by the Formulas (1) or (2), E is an anion other than sulfonic acid compound, t is a number of ionic valent of the anionic group E, u is an integer of 1 or 2, and s is a product of t and u.

2. The magenta toner of claim 1, wherein the compound A is a compound represented by Formulas (1) or (2).

3. The magenta toner of claim 1, wherein the compound A is a compound represented by Formula (3).

4. The magenta toner of claim 1, wherein the compound represented by Formula (1) is

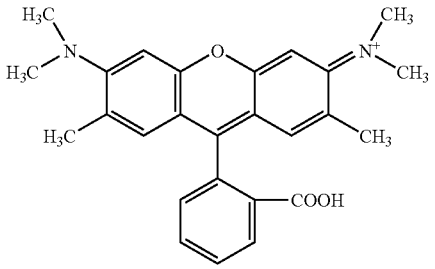

or

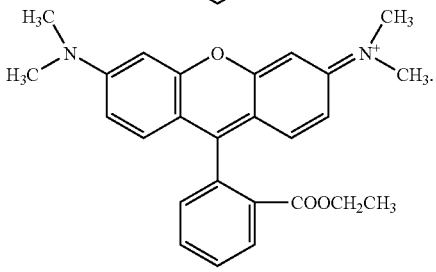

5. The magenta toner of claim 1, wherein the compound represented by Formula (2) is

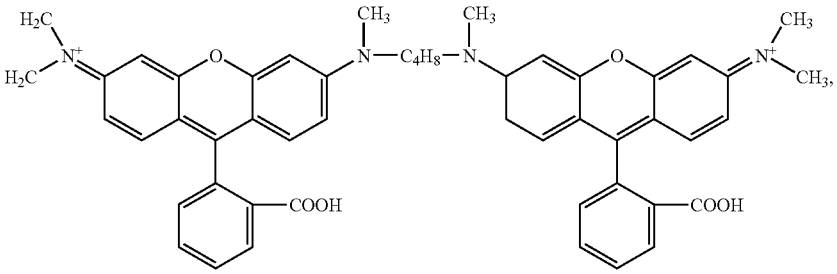

-continued

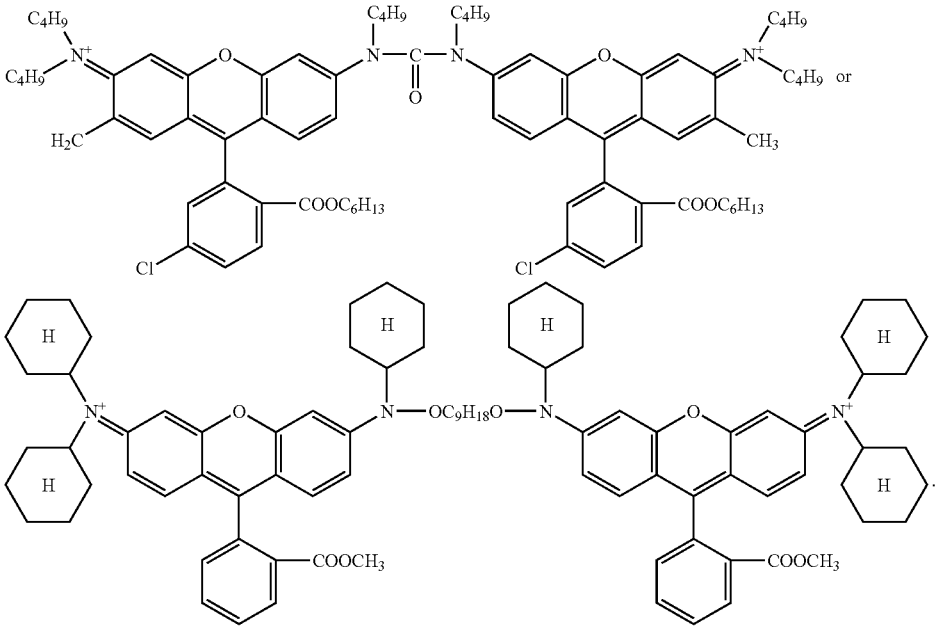

6. The magenta toner of claim 1, wherein E in the formula (3) is $O^{2-}$, $Cl^{-}$ or $CH_3(CH_{20})COO^{-}$.

7. The magenta toner of claim 1, wherein the compound represented by Formula (3) is (3-1)

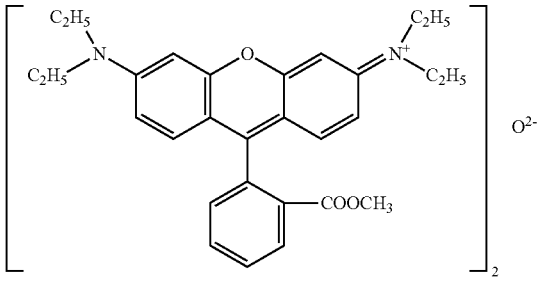

(3-2)

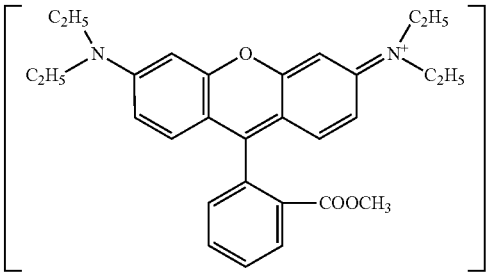

-continued (3-3)

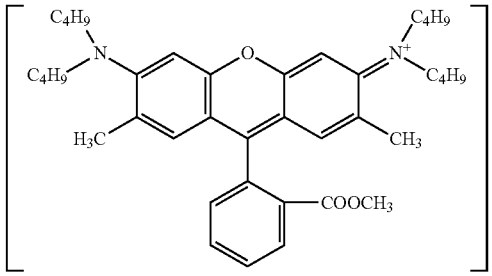

$CH_3(CH_2)_{20}COO^{-}$.

8. The magenta toner of claim 1, wherein the compound B is selected from a group consisting of C.I. Pigment Red 48:4, C.I. Pigment Red 57, C.I. Pigment Red 7, C.I. Pigment Red 8, C.I. Pigment Red 14, C.I. Pigment Red 238, C.I. Pigment Red 5, C.I. Pigment Red 31, C.I. Pigment Red 146, C.I. Pigment Red 147, C.I. Pigment Red 184, C.I. Pigment Red 187, C.I. Pigment Red 212, C.I. Pigment Red 213, C.I. Pigment Red 222, C.I. Pigment Red 233, C.I. Pigment Red 283, C.I. Pigment red 81:4, and rhodamine silicomolybdate.

9. The magenta toner of claim 8, wherein the compound B is selected from a group consisting of C.I. Pigment Red 48:4, C.I. Pigment Red 57, C.I. Pigment Red 187, C.I. Pigment Red 212, C.I. Pigment Red 213, C.I. Pigment Red 222, C.I. Pigment Red 233, C.I. Pigment Red 238, and C.I. Pigment red 81:4.

10. The magenta toner of claim 1, wherein a softening point of the toner particles is not less than 65° C. and not more than 100° C.

* * * * *